US007770353B2

(12) United States Patent
Olsen

(10) Patent No.: US 7,770,353 B2
(45) Date of Patent: Aug. 10, 2010

(54) METHOD OF SEALING AN ATTIC ACCESS OPENING AND AN INSULATED ATTIC ACCESS OVER

(76) Inventor: Cliff Olsen, P.O. Box 1505, Blackfalds, Alberta (CA) T0M 0J0

( * ) Notice: Subject to any disclaimer, the term of this patent is extended or adjusted under 35 U.S.C. 154(b) by 684 days.

(21) Appl. No.: 11/656,256

(22) Filed: Jan. 22, 2007

(65) Prior Publication Data

US 2007/0193136 A1 Aug. 23, 2007

(30) Foreign Application Priority Data

Jan. 24, 2006 (CA) ..... 2535056

(51) Int. Cl.
*E04B 1/62* (2006.01)

(52) U.S. Cl. ..... 52/745.15; 52/19; 52/2.22; 52/406.2; 52/202

(58) Field of Classification Search ..... 52/2.12, 52/2.14, 2.17, 2.22, 2.19, 19, 406.1–406.3, 52/407.2–407.5, 202, 404.3, 514, 742.1, 52/745.15, 741.1; 49/315, 463, 466; 182/46, 182/47, 77; 126/544, 545, 547; 277/314, 277/316, 605, 645–646
See application file for complete search history.

(56) References Cited

U.S. PATENT DOCUMENTS 3,141,206 A * 7/1964 Stephens ..... 52/788.1
3,526,199 A * 9/1970 Keats ..... 156/93
3,909,010 A * 9/1975 Swanson et al. ..... 277/314
4,299,059 A 11/1981 Smith
4,346,132 A * 8/1982 Cheng et al. ..... 428/76
4,567,074 A 1/1986 Litaker
4,599,825 A * 7/1986 Sixsmith ..... 49/466
4,658,555 A 4/1987 Steiner
4,928,441 A 5/1990 Daley
4,944,126 A 7/1990 King
5,033,949 A * 7/1991 Jewett ..... 425/12
5,475,955 A 12/1995 Dickinson
5,481,833 A 1/1996 Williams
5,628,151 A 5/1997 Monat
5,867,946 A 2/1999 Seagren
6,014,841 A 1/2000 McCoy, Jr. et al.
6,223,490 B1 * 5/2001 Wessley et al. ..... 52/404.1
6,601,352 B1 8/2003 Obermeyer et al.
6,701,676 B1 3/2004 Kompelien
6,848,492 B2 * 2/2005 Thomas ..... 160/368.1
6,869,669 B2 3/2005 Jensen et al.
6,898,907 B2 * 5/2005 Diamond ..... 52/202
2003/0061776 A1 * 4/2003 Alderman ..... 52/404.1

* cited by examiner

*Primary Examiner*—Robert J Canfield
*Assistant Examiner*—Christine T Cajilig
(74) *Attorney, Agent, or Firm*—Davis & Bujold, P.L.L.C.

(57) ABSTRACT

A method of sealing an attic access opening; a first step for which involves providing an attic access opening with a peripheral interior sidewall. A second step involves providing an insulated attic access cover, which consists of a first panel having a peripheral edge and a second panel having a peripheral edge. A flexible web connects the peripheral edge of the first panel with the peripheral edge of the second panel, and defines an insulation cavity between the first panel and the second panel filled with compressible insulation. A third step involves positioning the insulated attic access cover within an attic access opening and moving the first panel and the second panel toward each other to compress the insulation in the insulation cavity and cause the insulation to bulge outwardly to engage the peripheral interior sidewall of the attic access opening.

3 Claims, 3 Drawing Sheets

METHOD OF SEALING AN ATTIC ACCESS OPENING AND AN INSULATED ATTIC ACCESS OVER

This application claims priority from Canadian Application Serial No. 2,535,056 filed Jan. 24, 2006.

FIELD OF THE INVENTION

The present invention relates to method of sealing an attic access opening and an insulated attic access cover constructed in accordance with the teachings of the present invention.

BACKGROUND OF THE INVENTION

The need to insulate an attic access cover which is positioned in an attic access opening has been addressed in a number of prior patents, such as U.S. Pat. Nos. 4,658,555 (Steiner 1987), 4,944,126 (King 1990) and 6,701,676 (Kompelien 2004).

SUMMARY OF THE INVENTION

According to one aspect of the present invention there is provided a method of sealing an attic access opening. A first step involves providing an attic access opening with a peripheral interior sidewall. A second step involves providing an insulated attic access cover, which consists of a first panel having a peripheral edge and a second panel having a peripheral edge. A flexible web connects the peripheral edge of the first panel with the peripheral edge of the second panel, and defines an insulation cavity between the first panel and the second panel. Compressible insulation fills the insulation cavity. The first panel and the second panel are movable toward each other. A second step involves positioning the insulated attic access cover within an attic access opening and moving the first panel and the second panel toward each other to compress the insulation in the insulation cavity and cause the insulation to bulge outwardly to engage the peripheral interior sidewall of the attic access opening.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 2:
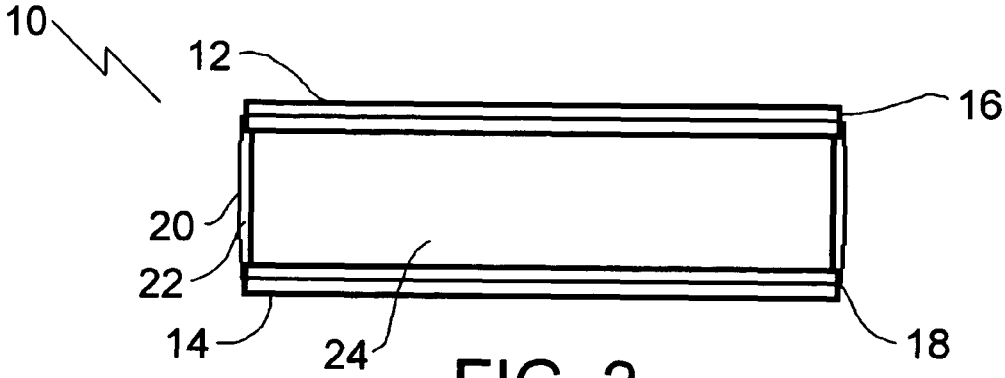
FIG. 2 is a side elevation view of the access cover in FIG. 1 in the expanded position.
Figure 3:
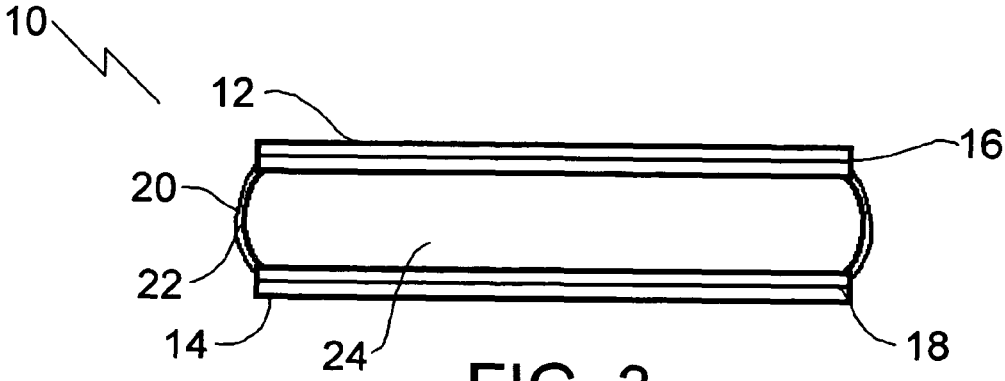
FIG. 3 is a side elevation view of the access cover in FIG. 1 in the compressed position.

The preferred embodiment, an insulated attic access cover generally identified by reference numeral 10, will now be described with reference to FIG. 1 through 3.

Figure 1:
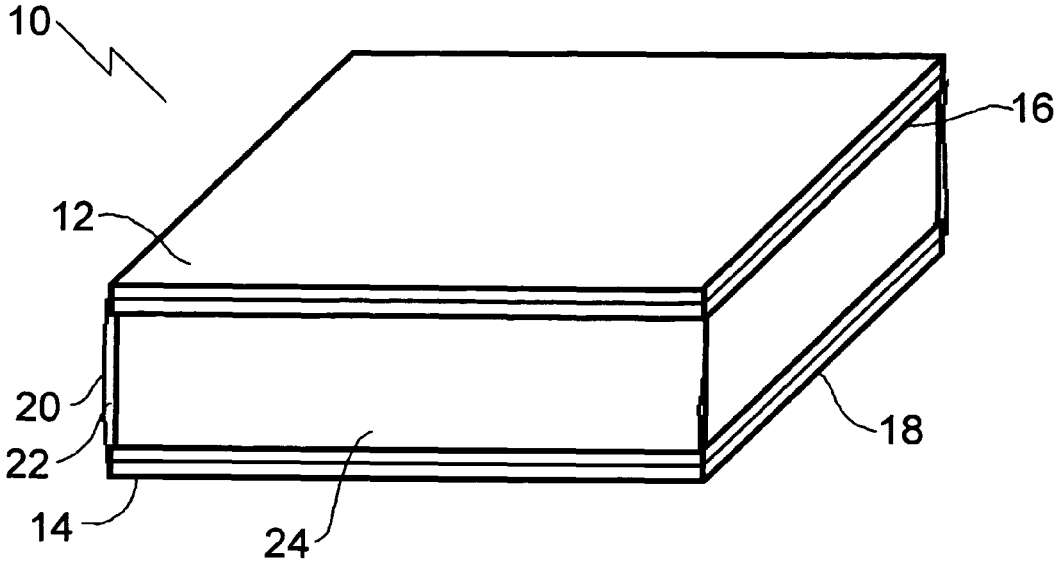
FIG. 1 is a perspective view of an access cover constructed in accordance with the teachings of the present invention.

Structure and Relationship of Parts:

Referring now to FIG. 1, insulated attic access cover 10 includes a first panel 12 and a second panel 14, each having a peripheral edge 16 and 18, respectively. Referring to FIG. 2, a flexible web 20, such as plastic, connects peripheral edge 16 of first panel 12 with peripheral edge 18 of second panel 14, and defines an insulation cavity 22 between first panel 12 and second panel 14. Compressible insulation 24 fills insulation cavity 22. Referring to FIG. 3, first panel 12 and second panel 14 are movable toward each other, thereby compressing insulation 24 in insulation cavity 22 and causing insulation 24 to bulge outwardly.

Figure 4:
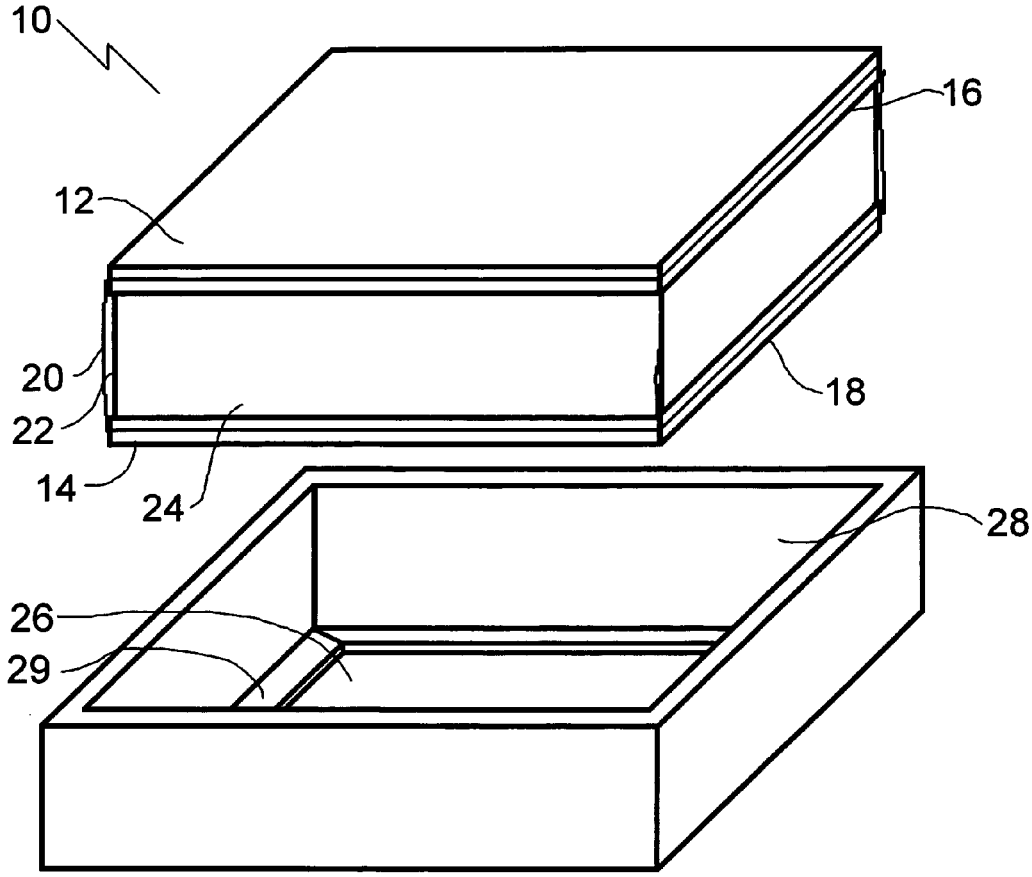
FIG. 4 is a perspective view of the access cover in FIG. 1 positioned over a an attic access opening.
Figure 5:
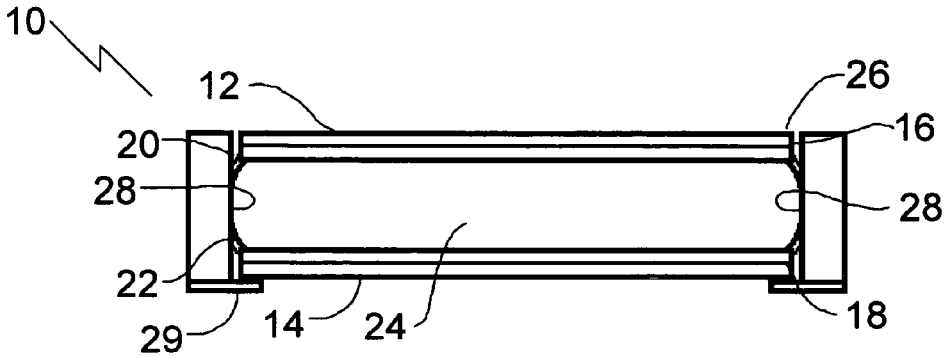
FIG. 5 is a side elevation view of the access cover in FIG. 1 position within the attic access opening.
Figure 6:
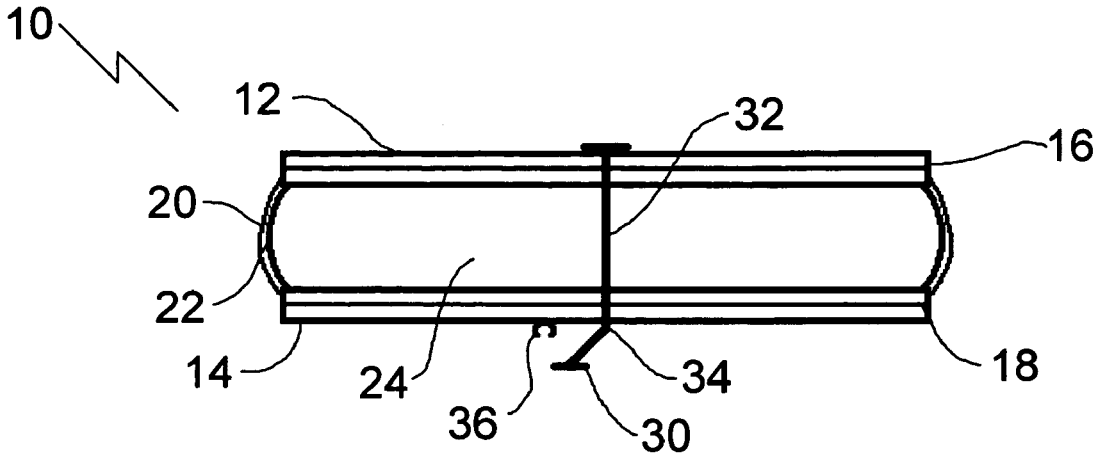
FIG. 6 is a side elevation view of an alternative access cover.

Operation:

Referring now to FIGS. 4 and 5, a method of sealing an attic access opening 26 will be discussed using attic access cover 10 as described above with reference to FIG. 1 through 3. Referring to FIG. 4, attic access opening 26 is provided with a peripheral interior sidewall 28 and a stop 29 that extends into opening 26 from the bottom of interior sidewall 28. Referring to FIG. 5, insulated attic access cover 10 is then positioned within attic access opening 26 such that it rests on stop 29. First panel 12 and second panel 14 are then moved toward each other to compress insulation 24 in insulation cavity 22 and cause insulation 24 to bulge outwardly. Flexible web 20 attaches between first panel 12 and second panel 14 to maintain insulation cavity 22 and maintain insulation 24 within insulation cavity 22. Thus, insulation 24 engages peripheral interior sidewall 28 of attic access opening 26. As depicted, the weight of first panel 12 causes it to move toward second panel 14 by force of gravity.

Variations:

Referring now to FIG. 4, relative movement of first panel 12 and second panel 14 toward each other may be caused mechanically, such as by pulling on a handle 30 that is attached to a shaft 32. As shaft 32 is attached to first panel 12, pulling on handle 30 causes it to move toward second panel 14. Once an appropriate compression of insulation 24 has been achieved, shaft 32 may be bent at a hinge 34 and handle 30 may be clipped into a clip 36 to maintain the relative position of first panel 12 and second panel 14. Other mechanical means of compressing panels 12 and 14 will be apparent to those skilled in the art.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A method of sealing an attic access opening, the method comprising the steps of:

providing an attic access opening with a peripheral interior sidewall;

providing an insulated attic access cover, comprising:

a first panel having a peripheral edge a second panel having a peripheral edge;

a flexible web connecting the peripheral edge of the first panel with the peripheral edge of the second panel, and defining an insulation cavity between the first panel and the second panel filled with compressible insulation;

positioning the insulated attic access cover within an attic access opening;

moving the first panel and the second panel toward each other to a compressed position wherein the insulation in the insulation cavity is compressed, causing the insulation to bulge outwardly to engage the peripheral interior sidewall of the attic access opening; and maintaining the first and second panels in the compressed position to secure the attic access cover against the peripheral interior sidewall of the attic access opening.

2. The method as defined in claim 1, wherein means are provided to mechanically cause relative movement of the first panel and the second panel toward each other.

3. A method of sealing an attic access opening, the method comprising the steps of:

providing an attic access opening with a peripheral interior sidewall;

providing an insulated attic access cover, comprising:

a first panel having a peripheral edge a second panel having a peripheral edge;

a flexible web connecting the peripheral edge of the first panel with the peripheral edge of the second panel, and defining an insulation cavity between the first panel and the second panel filled with compressible insulation;

positioning the insulated attic access cover within an attic access opening;

moving the first panel and the second panel toward each other to compress the insulation in the insulation cavity and cause the insulation to bulge outwardly to engage the peripheral interior sidewall of the attic access opening, and the first panel and the second panel move toward each other by force of gravity.

* * * * *